US012213549B2

(12) United States Patent
Imani

(10) Patent No.: US 12,213,549 B2
(45) Date of Patent: Feb. 4, 2025

(54) CONVERTIBLE LACE WIG

(71) Applicant: Sasan Imani, Clifton, NJ (US)

(72) Inventor: Sasan Imani, Clifton, NJ (US)

( * ) Notice: Subject to any disclaimer, the term of this patent is extended or adjusted under 35 U.S.C. 154(b) by 0 days.

(21) Appl. No.: 18/135,576

(22) Filed: Apr. 17, 2023

(65) Prior Publication Data

US 2024/0341385 A1 Oct. 17, 2024

(51) Int. Cl.
*A41G 3/00* (2006.01)

(52) U.S. Cl.
CPC ..... *A41G 3/0041* (2013.01); *A41G 3/0066* (2013.01)

(58) Field of Classification Search
CPC ..... A41G 3/0041; A41G 3/005; A41G 3/0058
See application file for complete search history.

(56) References Cited

U.S. PATENT DOCUMENTS 5,988,177 A * 11/1999 Bate ..... A41G 3/00 132/54
2006/0260627 A1* 11/2006 Park ..... A41G 3/00 132/54
2010/0192965 A1* 8/2010 Kang ..... A41G 3/0041 132/54
2013/0019889 A1* 1/2013 Palmer-Rogers .... A41G 3/0041 132/54
2014/0251362 A1* 9/2014 Lee ..... A41G 3/00 132/54
2017/0290385 A1* 10/2017 Suh ..... A41G 3/0075
2018/0064194 A1* 3/2018 Sutton ..... A42B 1/041
2019/0059486 A1* 2/2019 Kim ..... A41G 3/005

* cited by examiner

*Primary Examiner* — Rachel R Steitz
*Assistant Examiner* — Brianne E Kalach
(74) *Attorney, Agent, or Firm* — Joshua Kaplan; Kaplan Law Practice LLC

(57) ABSTRACT

The present invention is a wig comprising a base cap section, a first lace top section, a second lace top section, an anchoring rim, and wig hair. The base cap section corresponds to at least a user's crown region and right and left temporal regions when the wig is worn by the user. The first lace top section corresponds to at least the user's forehead region and frontal scalp region when the wig is worn by the user. The second lace top section corresponds to the user's mid-scalp region when the wig is worn by the user. The base cap section is coupled to side edges of the first lace top section and to posterior and side edges of the second lace top section. The first top lace section is coupled along its posterior edge to the second top lace section along its anterior edge.

12 Claims, 9 Drawing Sheets

CONVERTIBLE LACE WIG

FIELD OF THE INVENTION

The present invention relates to hair pieces, or wigs, in particular to a novel wig cap and method of assembly thereof.

BACKGROUND OF THE INVENTION

Hair pieces are worn by men and women who have lost or are losing their own hair, wish to hide their natural hair, or desire to change their look. Certain women, who are obligated to cover their hair in accordance with their faith, but who still want or need to appear as having hair, wear hair pieces that often match their natural hair colors and styles. The latter category of wearers often wears wigs for the duration of the day, and to many different circumstances and occasions. Most wig users have more than one hair piece, with each styled or cut in a specific fashion.

It is highly preferable that a wig piece appears as natural as wearer's own hair. This appearance is usually preserved when a wearer styles the hair piece in a manner for which the wig was intended by the manufacturer. Any deviation from the intended use causes the artificiality of the wig to become more evident to an onlooker. Therefore, if a wig is layered naturally or with hair "down" and a wearer then makes the wig into a Fall Wig by adding a headband, the hair layering may become frizzed or flared at the sides. If a "down" hair wig is made into a ponytail, the hair in some areas may appear lumpy or bubbling. The conspicuousness of a hair piece increases when a "down" wig is turned into a Band Fall or a Ponytail.

Definitions

A Regular Wig or "Down" wig is a wig that is produced to be worn with hair naturally arranged as "falling" by the side, or in a specific hair style.

A Band fall or a Fall Wig is a wig that is intended to be worn with a headband in the front. Such wigs frequently do not have hair bangs.

A Pony wig or Hat Fall is a wig intended to be worn in a pony, with majority of the hair oriented to be tied into a ponytail or directed to fall down the back of the wearer's head, with or without a hat fashioned at the top.

SUMMARY OF THE INVENTION

The disclosed invention is a novel wig cap and a method of making the same. The disclosed wig cap is comprised of a base cap section and a top lace section. The top lace section is configured to correspond to the top portion of a wearer's head. For the sake of the instant description, the top lace section is subdivided into two parts. The first part is the first lace section, which is comprised of only lace to which a plurality of hair strands has been securely fastened. The purpose for the first part is to replicate a wearer's parting of the heir at the top of the head, otherwise known as the "part." The part is the second lace top section, which comprises of a plurality of hair wefts that are oriented parallel to the wearer's forehead and perpendicular to the plurality of hair wefts comprising the base cap. With respect to a wearer's forehead, the first section would be adjacent to the forehead, separating the forehead from the second part of the wig cap.

The individual hair strands on the hair wefts are generally oriented to fall perpendicular to the direction of the weft.

Therefore, if a weft is installed from the left side to the right side (or from the right side to the left side) of the wig cap, or across the top of wearer's head, the hair on the weft will generally fall either down the front or down the back portions of a wig cap. Therefore, the hair of the second section that is installed from left to right across the top lace section will be oriented to fall down the back and rearward sides of the wearer's head, and if brushed forward, it will also lay naturally down across the first section of the wig cap. The arrangement of the hair strands to be biased toward the back of the head works well for a Band Fall and Pony Wigs that naturally cluster hair strands towards the back part of the head. When hair strands are biased toward the back of the head, there is no lumping when hair is clustered at the back for the Band Fall or Pony styles. The hair of first and second portions will also work well for a Regular Wig, where the stands are allowed to fall naturally.

It is the object of the present invention to create a wig cap that may be worn as a Band Fall or as a Pony Wig without sacrificing the natural appearance of the wig. It is another object of the present invention to create a wig cap where hair strands are directed to fall down the back of a wearer's head without appearing out of place or lumpy as a Regular Wig. It is still another object of the present invention to create a wig cap where the top lace portion is faster and easier to make, and is more durable, without sacrificing the natural appearance of a wig piece having a lace part.

DESCRIPTION OF THE PREFERRED EMBODIMENTS

Figure 1:
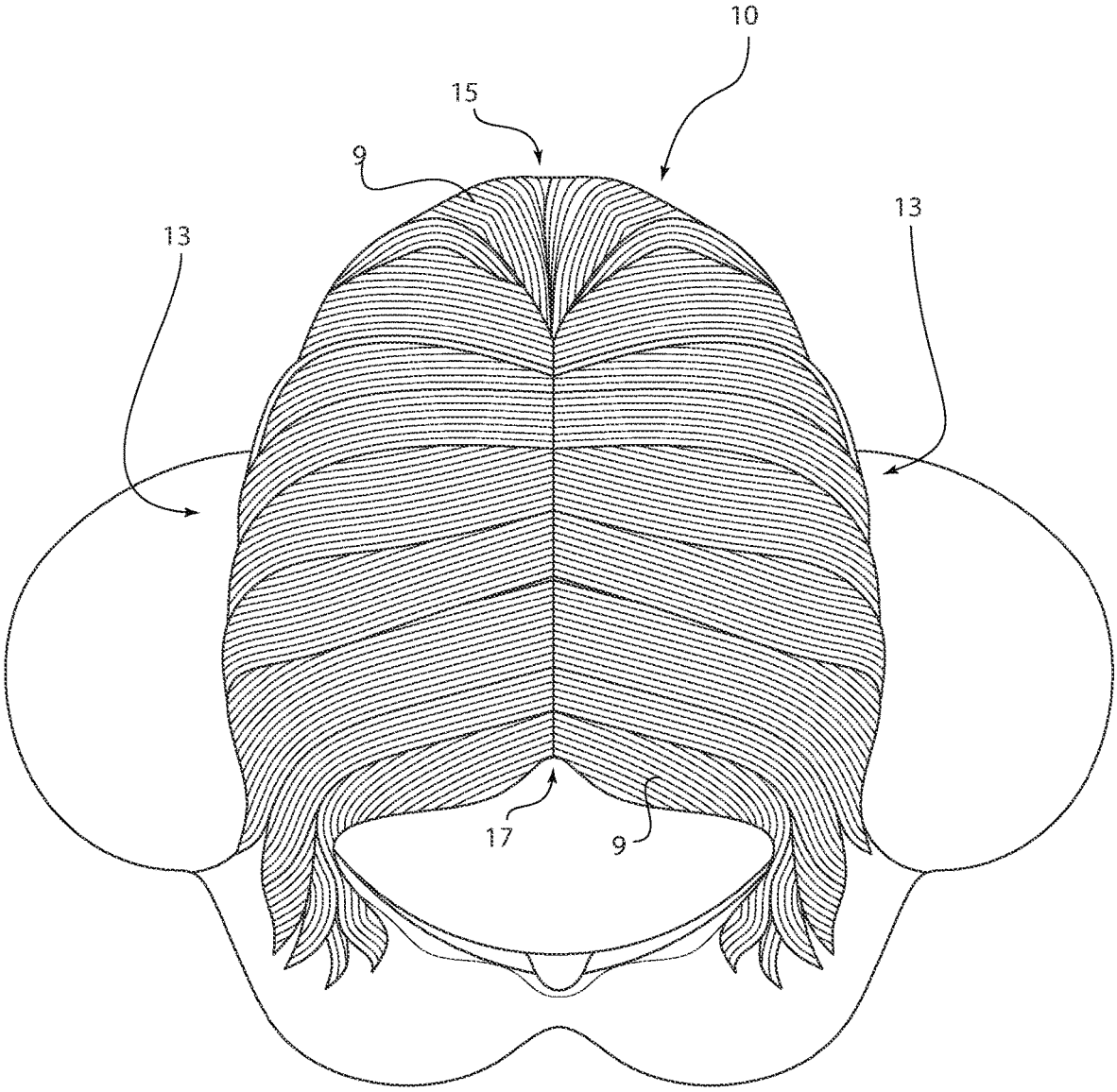
FIG. 1 is a perspective view of a full wig according to one embodiment of the present invention.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Reference will be made in detail to the embodiments of the disclosure, examples of which are illustrated in the accompanying drawings. The presentation of reference numerals within parentheses indicates that the mentioned reference numeral appears in a figure other than the figure(s) under discussion. As will be described below in connection with the drawings, the invention enables a wig 10 to be worn (a) as a full wig (see FIG. 1 through FIG. 3); or (b) as a full wig with a hairband down about the middle of the user's head (see FIGS. 4 and 5); or (c) as a Band Fall wig without bangs (see FIGS. 6 and 7); or (d) in a ponytail (see FIG. 8).

FIG. 1 illustrates, according to one embodiment, a full wig 10 having wig hair 9 issuing centrifugally in the direction 11 down the sides 13 and back 15 from the center 17. Hair strands 9 generally issue centrifugally or outwardly from the cap and then cascade down the sides 13 and the back 15.

Figure 2:
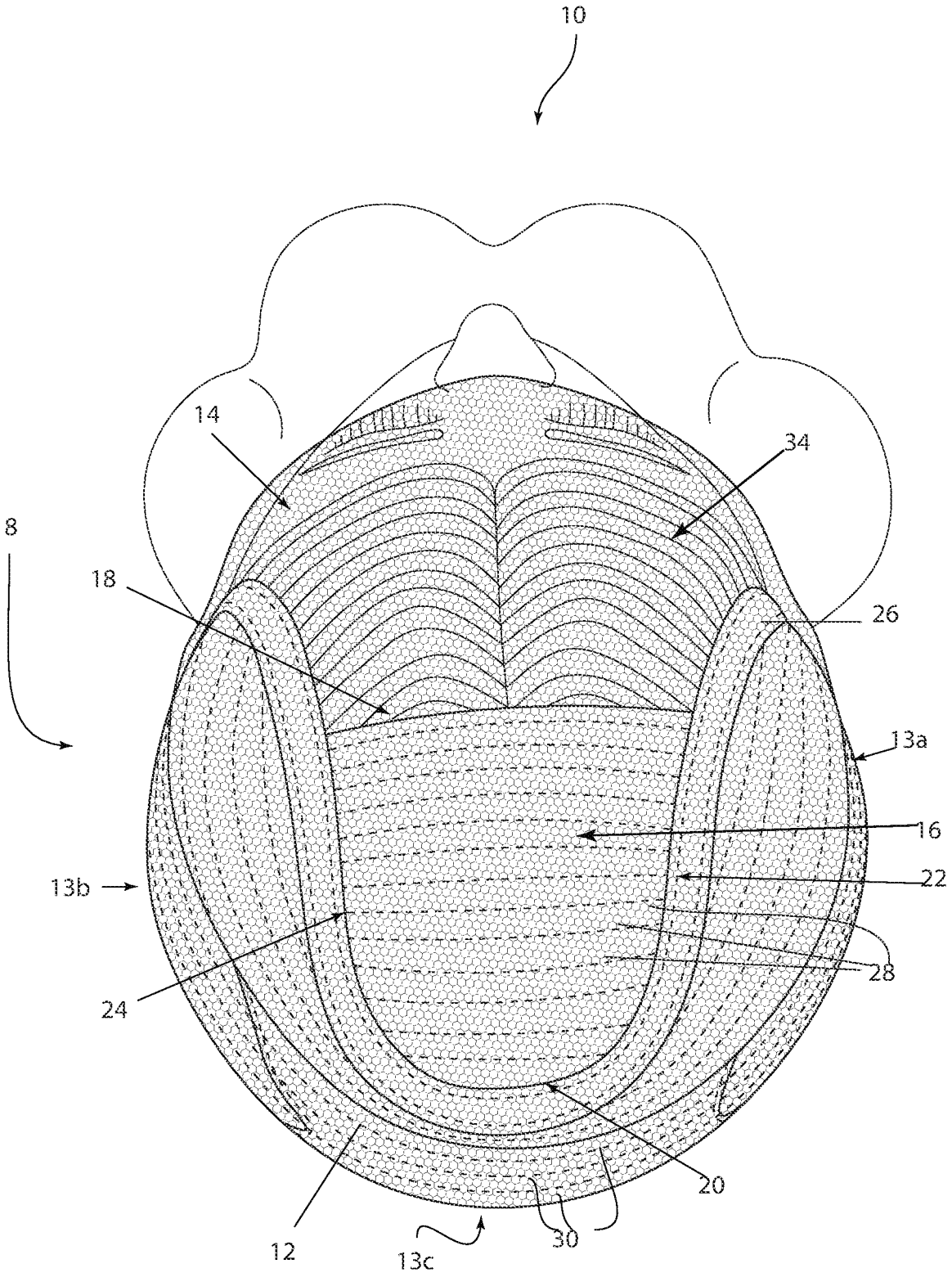
FIG. 2 is a top view of an inverted wig according to one embodiment of the present invention.
Figure 3:
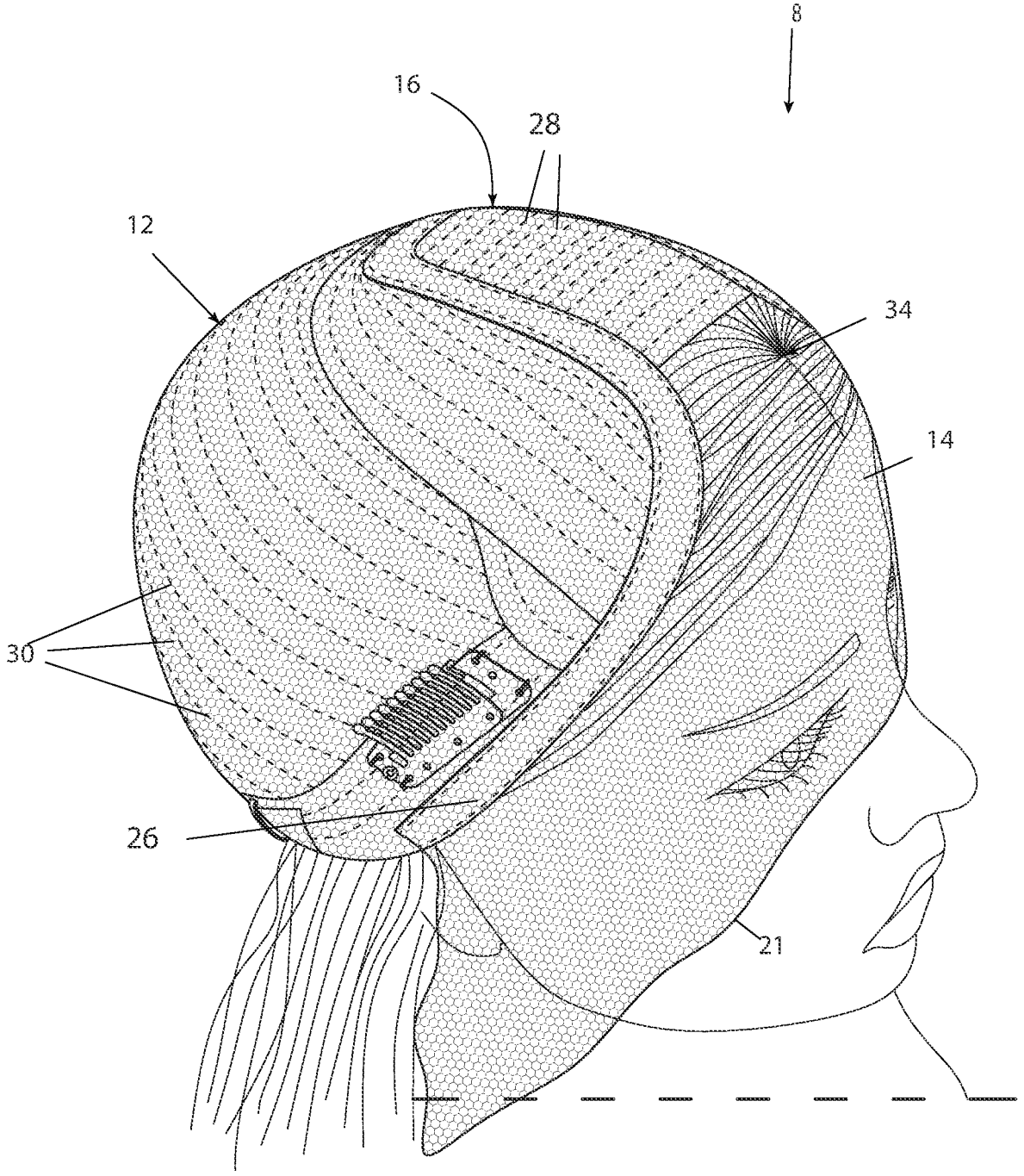
FIG. 3 is a perspective view of an inverted wig according to one embodiment of the present invention.

FIGS. 2 and 3 illustrate, according to one embodiment, a wig cap 8 of a wig in an inverted orientation, with wig cap 8 being shown on top (with the hair level hair 9 below the wig cap 8). Or stated another way, showing the inside view of a disclosed wig 10—comprising a wig cap 8, having a base cap section 12, a first lace top section 14, a second lace top section 16 (also known as second portion), an anchoring rim 26, and a plurality of top hair ribbons or wefts 28 and base cap hair ribbons or wefts 30. The dashed lines shown in FIGS. 2 and 3 denote where the hair 8 of the top hair ribbons 28 and base cap hair ribbons 30 are knotted. The first lace top section 14 comprises the general lace top section 14 and the first portion 34 that adjoins the second lace top section 16 at the top of the wig cap 8.

Base cap section 12 corresponds to at least a crown and nape regions of a user's head, along with right and left temporal regions 13*a* and 13*b* respectively, when the wig cap 8 is worn by a user. First lace top section 14 corresponds to at least a user's forehead region and frontal scalp region when wig 10 is worn by the user. First top lace section 14 has an anterior edge, a posterior edge, and right and left side edges. Second lace top section 16 corresponds to the user's mid-scalp region when wig 10 is worn by the user.

Second top lace section 16 has an anterior edge 18, a posterior edge 20, a right side edge 22 and a left side edge 24. Base cap section 12 is coupled to the side edges of first lace top section 14. Base cap section 12 is coupled to the posterior edge 20 and right and left side edges 22 and 24 of second lace top section 16. The posterior edge of first portion 34 of the top lace section 14 is coupled to the anterior edge 18 of second top lace section 16. Anchoring rim 26 is coupled to the side edges of first lace top section 14 and to the posterior edge 20 and right and left side edges 22 and 24, respectively of the second lace top section 16.

In the embodiment shown, top hair ribbons or weft 28 comprises a weft of wig hair sown together in a ribbon, usually using a machine. In one embodiment, the plurality of top hair ribbons 28 are arrayed in parallel rows of varying lengths stretched across the top section 16 from the left edge 24 to the right edge 22, filling the space of the second lace top section 16 between the anterior edge 18 and the posterior edge 20, along about the same horizontal plane.

In one embodiment, top hair ribbons 28 are secured to anchoring rim 26. A first end of each of the top hair ribbons 28 is secured to a side of anchoring rim 26 proximate to the right side edge 22 of second lace top section 16, and a second end of each of the top hair ribbons 28 is secured to a second side of anchoring rim 26 proximate to the left side edge 24 of second lace top section 16.

The plurality of top hair ribbons 28 may be attached to the base cap section 12, or to a section of the first lace top 14 that overlaps with the second lace top section 16, in a number of different ways and sequences. For instance, in one embodiment, anchoring rim 26 is integrally formed with base cap section 12. In this embodiment, the plurality of top hair ribbons 28 are either attached individually to anchoring rim 26 or as part of a unitary sheet of fabric or lace that is attached to anchoring rim 26 as a single component. In another embodiment, anchoring portion 26 is added to the base cap section 12 at a later stage, when all wefts 28 or 30 and hair 9 are arranged. In this embodiment, the plurality of top hair ribbons 28 are attached to anchoring rim 26 either before or after anchoring rim 26 is attached to base cap section 12, or the top hair ribbons 28 and or base cap hair ribbons 30 are attached directly to a point or points along the wig cap 8. Further in this embodiment, the plurality of top hair ribbons 28 are either attached individually to anchoring rim 26 or as part of a unitary sheet that is attached to anchoring rim 26, or the wig cap 8 as a single element, as described above.

The wig hair 9 is oriented to flow perpendicular to the direction of the top weft 28. In connection with the embodiments shown in FIGS. 2 and 3, as described above, the direction of the length of top hair ribbons 28 is from side to side (e.g., from right 13*a* to left sides 13*b*). Accordingly, the hair 8 of the top weft 28 arranged of the second lace top section 16 is oriented to flow in the direction away from about the coronal plane (i.e., from top/middle to back of the user's head) or down the back 13*c* and nape regions.

In one embodiment, the plurality of base cap hair ribbons 30 contain machine weft wig hair, which are secured directly or indirectly onto base cap 12 in concentric semi-circles (or other patterns) of varying lengths. In one embodiment, similar to the above description regarding the top hair ribbons 28, the machine weft wig hair of the base cap hair ribbons 30 is also oriented to flow perpendicular to the direction of the length of base cap hair ribbons 30. As described above in connection with FIGS. 2 and 3, base cap section 12 corresponds to at least a user's crown region and right and left temporal regions when wig 10 is worn by a user, and the direction of the length of base cap hair ribbons 30 is generally in concentric semi-circles. Accordingly, the machine weft wig hair arranged in the base cap section 12, proximate to the user's crown (when wig 10 is worn), is oriented to flow in the direction away from about the coronal plane (i.e., from proximate middle 17 to the respective sides of the user's head). Similarly, the machine weft wig hair arranged in the base cap section 12, proximate to the user's right and left temporal regions (when wig 10 is worn), is oriented to flow in the direction away from about the sagittal plane (i.e., from proximate middle to the respective right and left sides of the user's head).

In one embodiment, the first lace top section 14 is provided with excess lace material. In the examples of FIGS. 2 and 3, the frontal edge 21 will be cut or trimmed according to the needs of the particular user, whereby a new anterior edge of the first lace top section 14 is formed. FIG. 3 additionally illustrates, according to one embodiment, a hair comb clip 32 for securing wig 10 by clipping base cap 12 to the user's natural hair.

Figure 4:
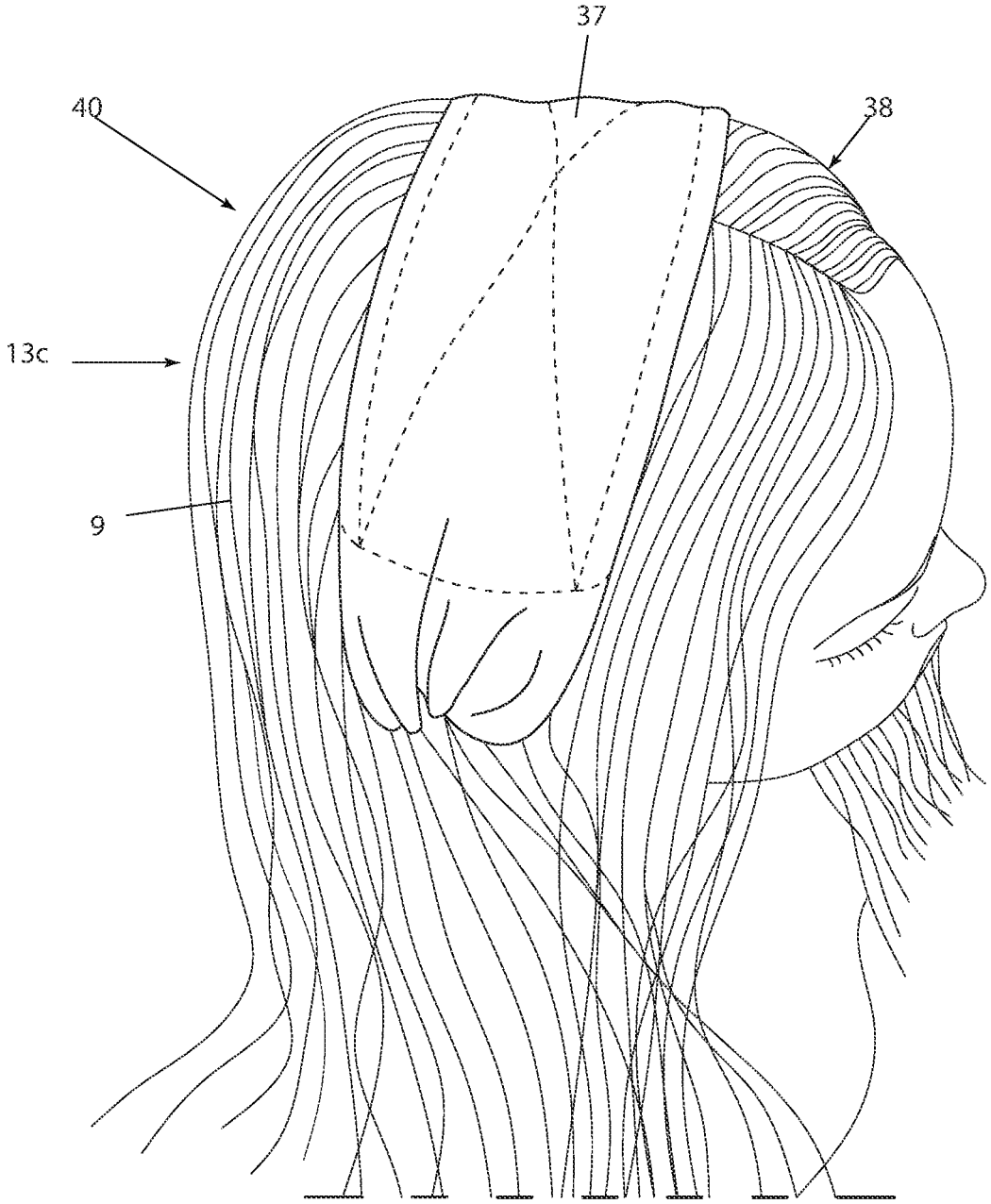
FIG. 4 is a perspective view of a wig with a middle headband according to one embodiment of the present invention.
Figure 5:
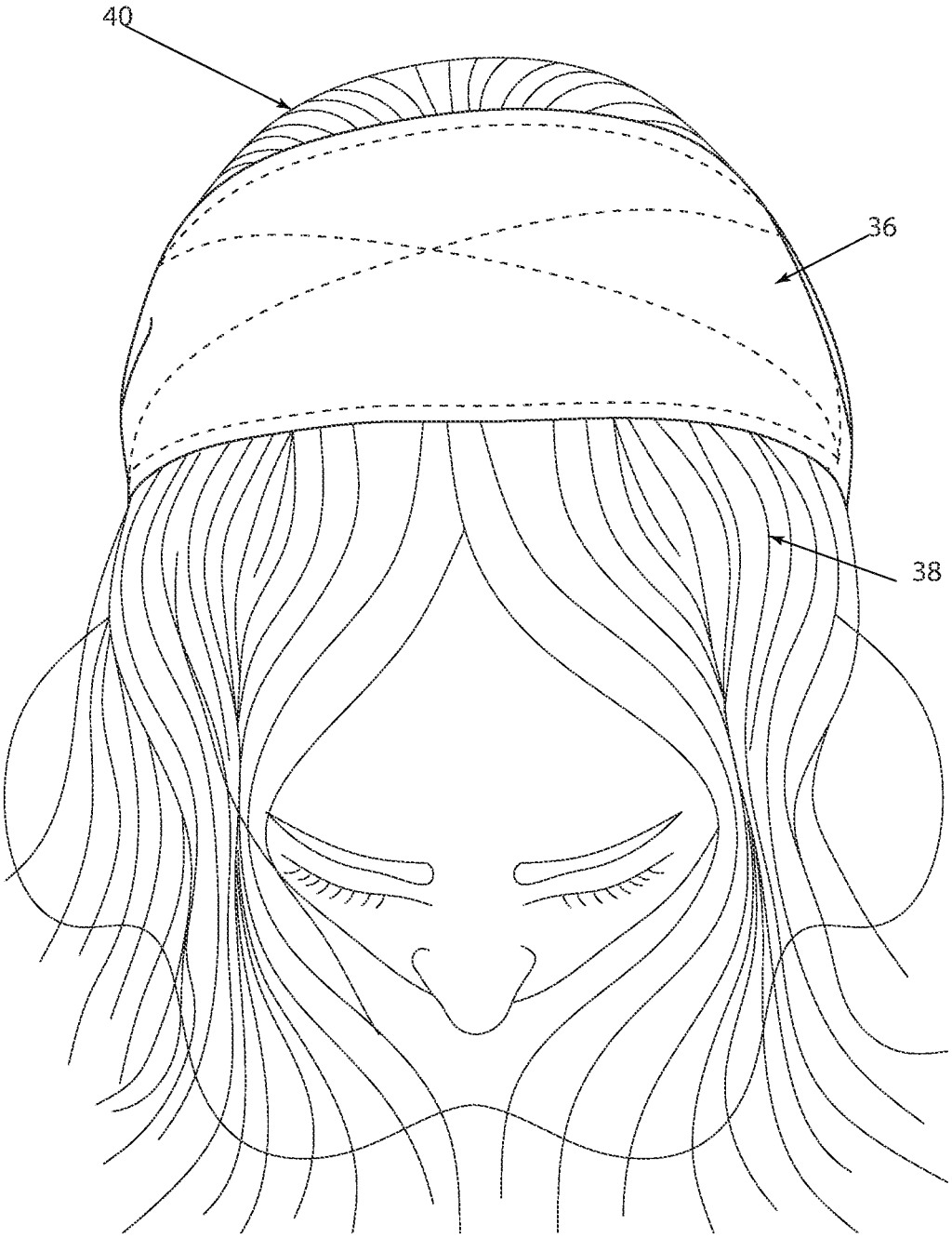
FIG. 5 is a perspective view of a wig with a middle headband according to one embodiment of the present invention.

FIGS. 4 and 5 illustrate, according to one embodiment, a full wig similar to the full wig (10) described above in connection with FIGS. 1 through 3, which further includes a middle headband 36 of any conventional configuration. In one embodiment, anterior wig hair 38 is hand sewn to first lace top section (14). In one embodiment, the first portion of posterior wig hair 40 is machine sewn to the second top lace section (16), and a second portion of posterior wig hair 40 is machine sewn base cap section (12). Alternatively, the entire wig hair 9 may be machine or hand sown to the wig cap (8). As visible in FIGS. 4 and 5, the wig hair 9 is collected toward the posterior 40. Therefore, the natural tendency of the hair 9 of the second top lace section 16 to cascade down the posterior 40 assists in minimizing the artificial appearance of the wig 10 and rather maximizes the natural "wearer's own hair" perception.

In one embodiment, headband 36 is detachably coupled to wig 10. In another embodiment, headband 36 is integrally formed with wig 10. It is preferred however that the headband 36 is a separate component mounted onto wearer's hair after or contemporaneously with the donning of the wig by its wearer.

The embodiments for attaching the plurality of top hair ribbons (28) to the base cap section (12), described above in connection with FIGS. 2 and 3, may be applied to the embodiment(s) illustrated in FIGS. 4 and 5. The orientation of the hair 8 in the base weft 30 or the top weft 28 wig hair in the embodiments described in connection with FIGS. 4 and 5 is similar or the same as the embodiments described above in connection with FIGS. 2 and 3.

Figure 6:
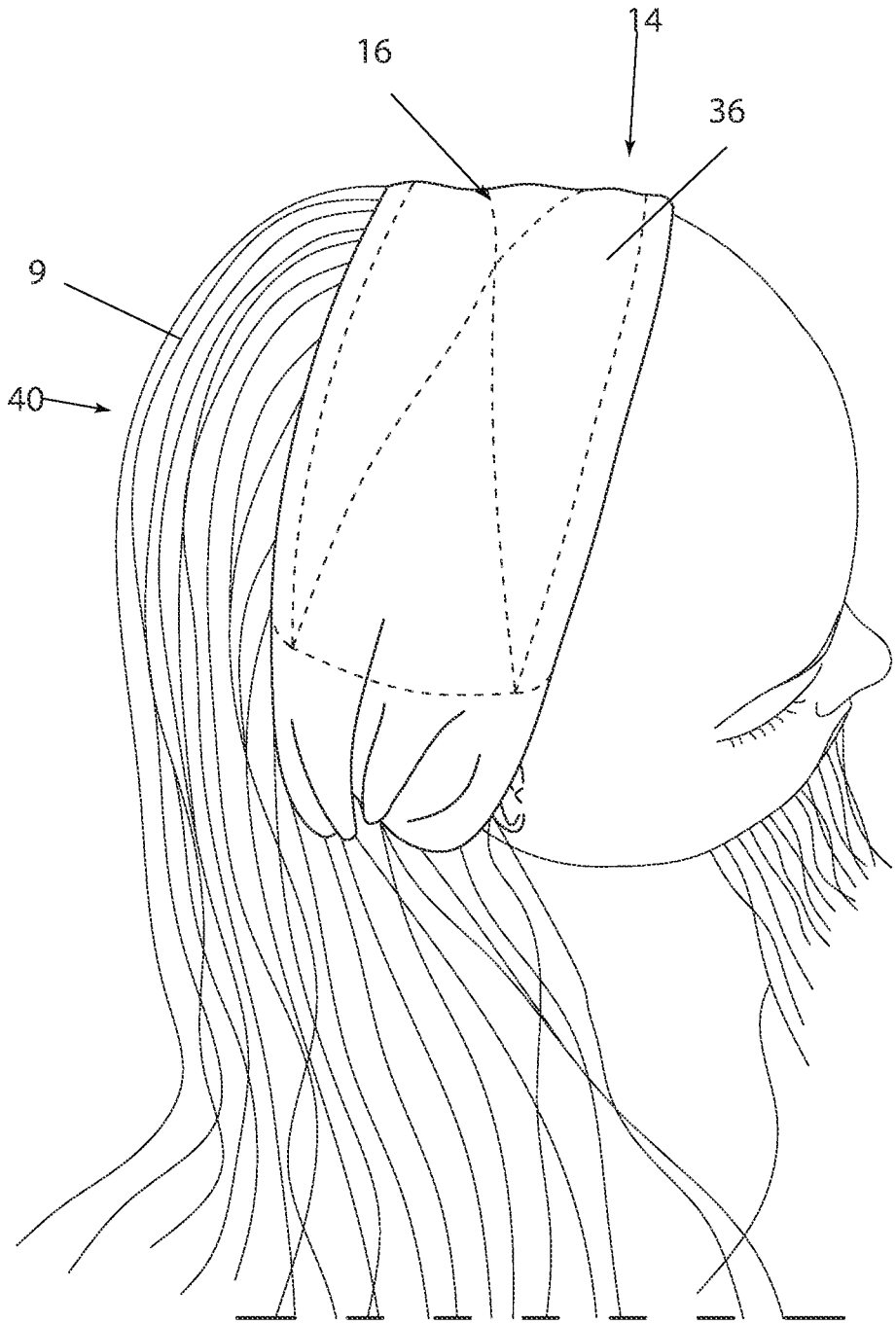
FIG. 6 is a perspective view of a fall wig according to one embodiment of the present invention.
Figure 7:
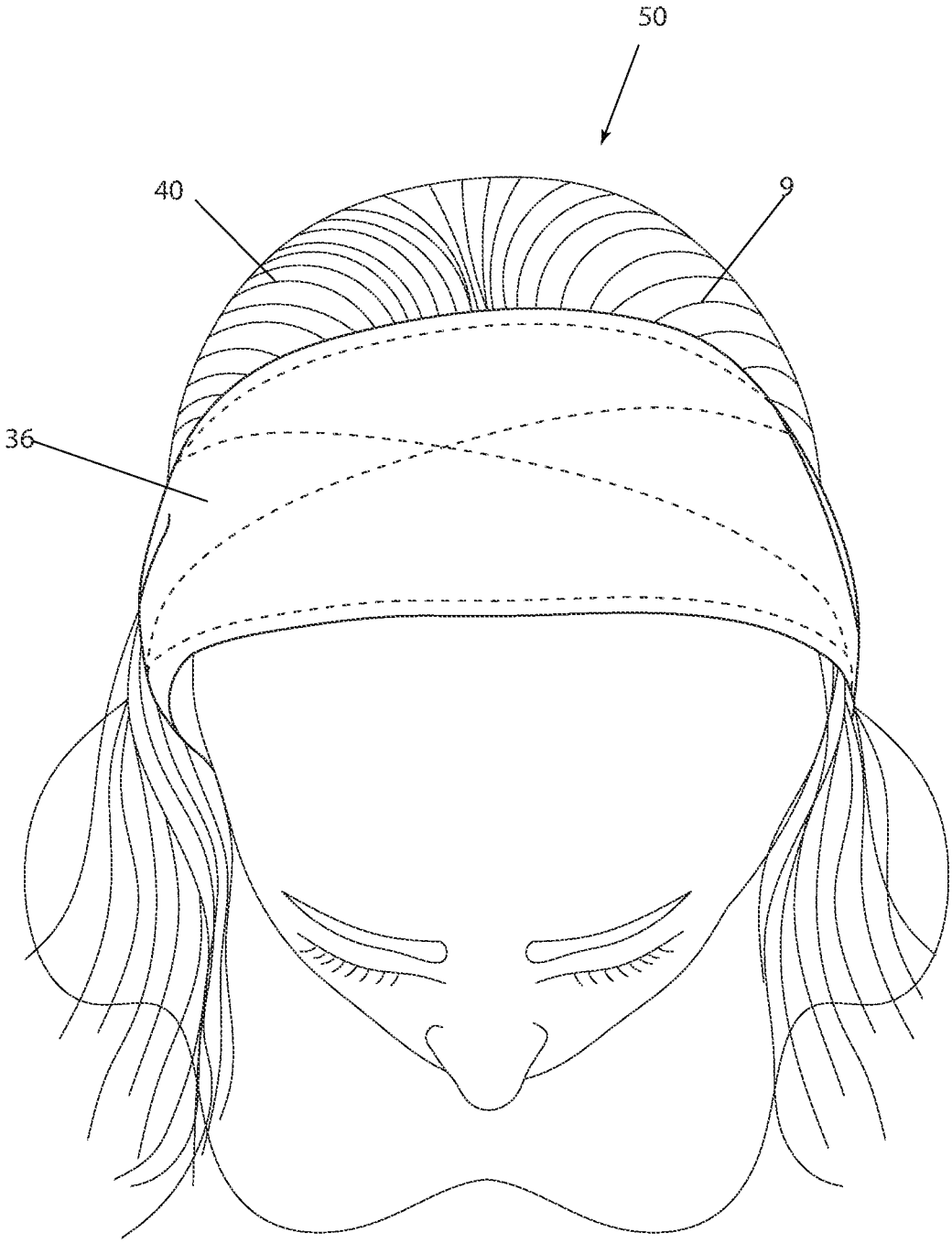
FIG. 7 is a perspective view of a fall wig according to one embodiment of the present invention.

FIGS. 6 and 7 illustrate, according to one embodiment, a Fall wig 50 similar to the full wig described above in connection with FIGS. 1 through 3. The headband 36 is moved forward over the first top lace section (14). Accordingly, the fall wig 50 still comprises the comprises the base cap section (12), the second top lace section (16), the anchoring rim (26), and the first top lace section (14), which is now covered by the headband 36. Wig hair 9 is shown extending centrifugally down the sides and back from at least the center of fall wig 50. Notably, the prior art differs significantly from the embodiment shown in FIGS. 5-7, as the prior art calls for a separate wig style to be manufactured to support the Fall Wig configuration. In a conventional, or existing art, the Fall will would be comprised entirely of the base cap section 12 stretching from anterior edge (18) of the posterior or crown section of the head (13*c*). In some configuration the existing art would also include the first lace top section 14 that is shortened to accommodate or to leave room for the headband 36. Thus in the existing art, a Fall Wig cannot be a full wig, due to missing components, and a full wig cannot become a Fall Wig since the full lace section will tend to become lumpy as hair strands 9 are forced down the posterior side 40.

The embodiments for attaching the plurality of top hair ribbons (28) to the base cap section (12), described above in connection with FIGS. 2 and 3, may be applied to the embodiment(s) illustrated in FIGS. 6 and 7. The orientation of machine weft wig hair in the embodiments described in connection with FIGS. 6 and 7 is similar or the same as the embodiments described above in connection with FIGS. 2 and 3.

Figure 8:
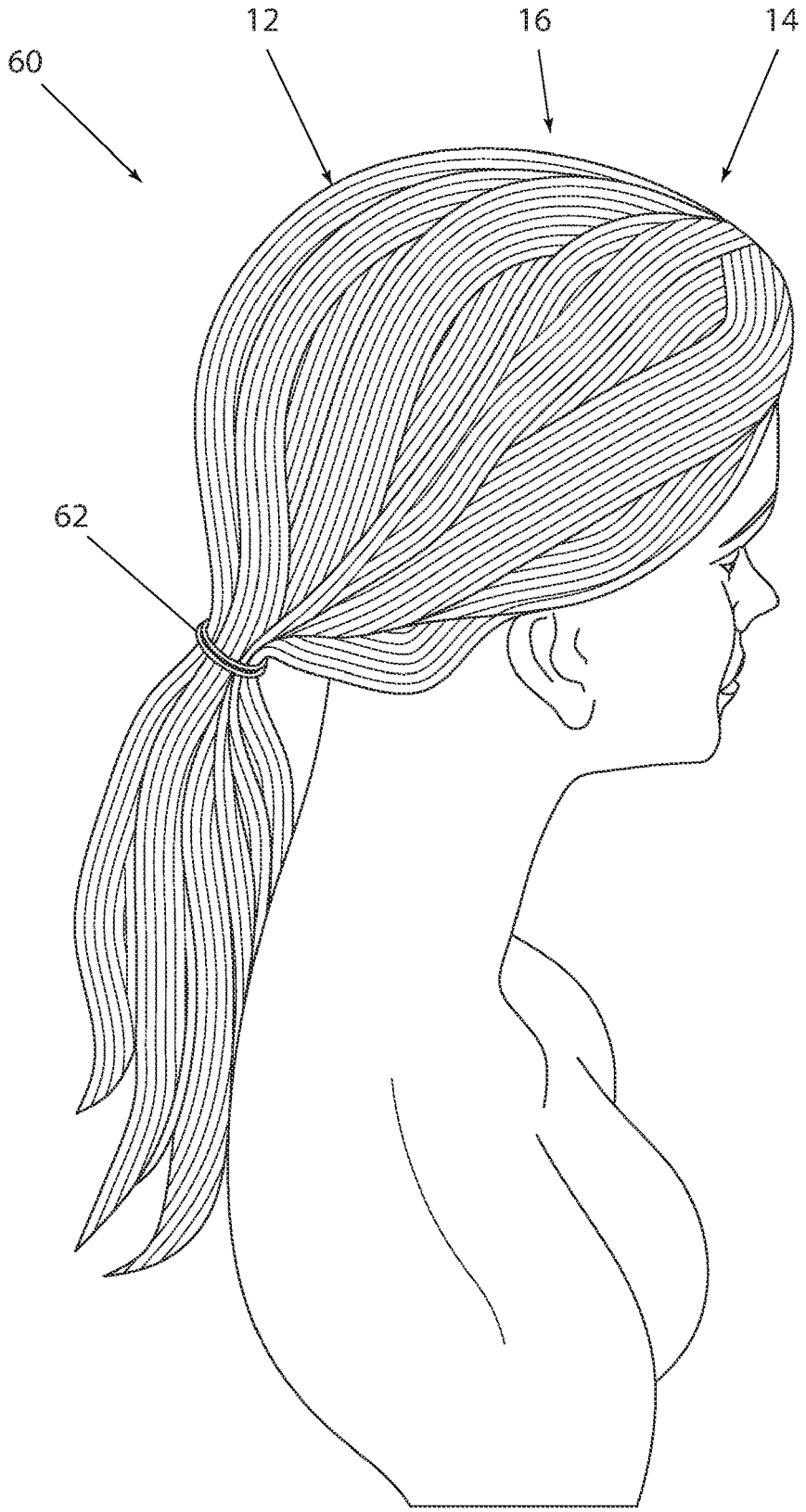
FIG. 8 is a perspective view of a ponytail wig according to one embodiment of the present invention.

FIG. 8 illustrates, according to one embodiment, a ponytail wig 60 similar to the full wig (10) described above in connection with FIGS. 1 through 3. In particular, the ponytail wig 50 comprises the base cap section (12), the first top lace section (14), the second top lace section (16), and the anchoring rim (26). In this embodiment, the wig hair 9 cascades centrifugally down the sides and back from the center is gathered into a pony and secured with a ponytail holder 62 or clasped into a hair clasp or a scrunchie. Notably the head band 36 as shown in FIGS. 6 and 7 may be applied along the front, or along the middle as in FIG. 5. The embodiments for attaching the plurality of top hair ribbons (28) to the base cap section (12), described above in connection with FIGS. 2 and 3, may be applied to the embodiment(s) illustrated in FIG. 8. The orientation of machine weft wig hair in the embodiments described in connection with FIG. 8 is similar or the same as the embodiments described above in connection with FIGS. 2 and 3.

Figure 9:
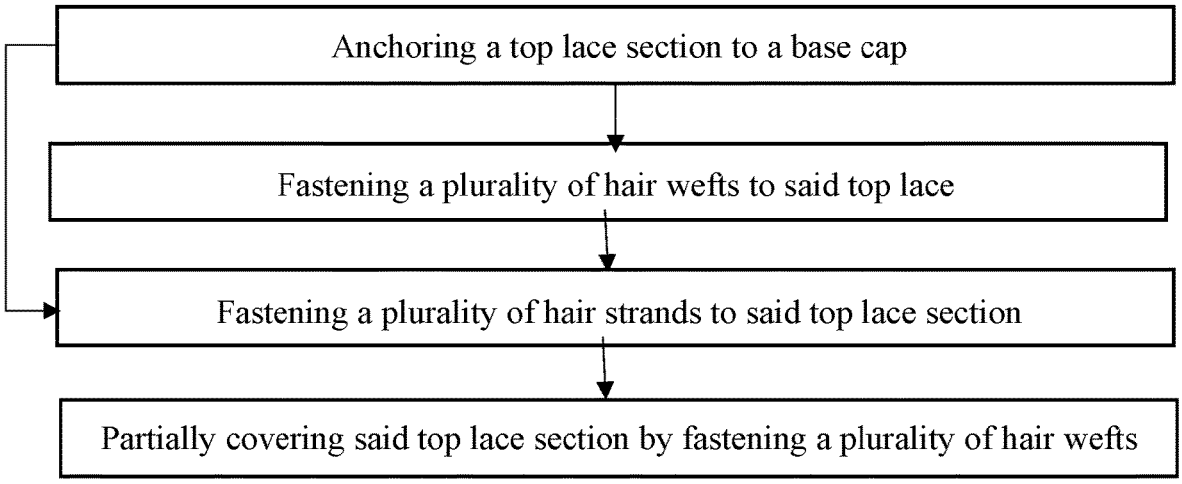
FIG. 9 demonstrates the method of assembling the wig cap disclosed in the present application.

FIG. 9 demonstrates the method for assembling the wig cap 8, starting with the steps of taking a base cap 12 and attaching a top lace section 14. The second top lace section 16 is then prepared by fastening top hair ribbons in a parallel and spaced apart configuration with each other to fill up the second top lace section 16 from left edge 24 to right edge 22 (or from right edge to left edge). Alternatively, the second top lace section 16 is first attached to the top lace section 14 that is separate from the base cap. In another alternative, the second top lace section 16 is anchored to anchoring rim 26, with the top lace section 14 fastened to the base cap 12, and additionally to the second top lace section 16. The individual hair strands 9 may be fastened to the top lace section 14 either before or after the coupling with the second top lace section 16.

Although this invention has been described with a certain degree of particularity, it is to be understood that the present disclosure has been made only by way of illustration and that numerous changes in the details of construction and arrangement of parts may be resorted to without departing from the spirit and the scope of the invention. While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims, as currently written or as amended or added in the future. Descriptions of exemplary methods or processes are not limited to inclusion of all steps as being required in all cases, nor is the order that the steps are presented to be construed as required or necessary unless expressly so stated.

What is claimed:

1. A wig comprising:

a base cap section corresponding to at least a user crown region and right, rear and left temporal regions when said wig is worn by said user;

an anchoring rim having two parallel lengthwise edges; wherein one of said two parallel lengthwise edges of said anchoring rim directly coupled to said base cap along one edge of said base cap;

a first lace top section and a second lace top section;

wherein said second lace top section corresponding to said user mid-scalp region when said wig is worn by said user, said second lace top section having an anterior edge, a posterior edge, and right and left side edges; wherein said posterior edge, and said right and left side edges directly coupled to a second one of said two parallel lengthwise edges of said anchoring rim;

wherein said first lace top section corresponding to at least said user forehead region and frontal scalp region when said wig is worn by said user, said first lace top section having an anterior edge, a posterior edge, and right and left side edges; wherein said right and left side edges of said first lace top section directly coupled to said second one of said two parallel lengthwise edges of said anchoring rim;

and wherein said posterior edge of said first lace top section is directly coupled to said anterior edge of said second lace top section;

a plurality of top hair ribbons arranged between said anterior edge of said second lace top section and said posterior edge of said second lace top section and said left side edge and said right side edge of said second lace top section, such that each ribbon of said plurality of top hair ribbons extends between the right and left edges of said second lace top section; and wherein said plurality of top hair ribbons configured to promote hair secured within said top hair ribbons to cascade down a posterior side of a wearer's head.

2. The wig of claim 1, wherein the base cap section forms a U-character shape surrounding said posterior and side edges of said second lace top section.

3. The wig of claim 1, wherein from said anterior edge of said second lace top section to said posterior edge of said second lace top section is a length of from 2 cm to 8 cm.

4. The wig of claim 1, wherein from said anterior edge of said first lace top section to a forward edge of said first lace top section is a length of from 2 cm to 8 cm.

5. The wig of claim 1, further comprising a plurality of hair weft sections, said plurality of said hair weft sections arranged from said anterior edge of said second lace top section to said posterior edge of said second lace top section.

6. The wig of claim 5, wherein said plurality of said hair weft sections are arranged in parallel rows in varying lengths along about the same horizontal plane.

7. The wig of claim 5, wherein a first end of each of said plurality of hair wefts is secured to a first side of said anchoring rim proximate to said right side edge of said second lace top section, and a second end of each of said plurality of hair wefts is secured to a second side of said anchoring rim proximate to said left side edge of said second lace top section;

whereby hair mounted within each of said plurality of hair wefts is oriented to issue in the direction away from about the coronal plane when said wig is worn by said user.

8. The wig of claim 1, further comprising a plurality of hair weft sections, said plurality of said hair weft sections arranged from said anterior edge of said second lace top section to said posterior edge of said second lace top section.

9. The wig of claim 8, wherein said plurality of said hair weft sections are arranged in parallel rows in varying lengths along about the same horizontal plane.

10. The wig of claim 8, wherein a first end of each of said plurality of hair wefts is secured to a first side of said anchoring rim proximate to said right side edge of said second lace top section, and a second end of each of said plurality of hair wefts is secured to a second side of said anchoring rim proximate to said left side edge of said second lace top section;

whereby hair mounted within each of said plurality of hair wefts is oriented to issue in the direction away from about the coronal plane when said wig is worn by said user.

11. The wig of claim 10, wherein said right and left sides edges of said first lace top section are curved.

12. The wig of claim 10, wherein said posterior edge of said second lace top section is curved.

* * * * *